US005235762A

United States Patent [19]

Brady

[11] Patent Number: 5,235,762

[45] Date of Patent: Aug. 17, 1993

[54] SNOW MELTING APPARATUS

[76] Inventor: Brian D. Brady, 16 White Pine La., Birchwood, Minn. 55110

[21] Appl. No.: 839,598

[22] Filed: Feb. 21, 1992

[51] Int. Cl.[5] ..... E01H 5/10

[52] U.S. Cl. ..... 37/228; 126/343.5 R; 298/1 H

[58] Field of Search ..... 37/227, 228, 229; 126/343.5 R; 298/1 H

[56] References Cited

U.S. PATENT DOCUMENTS

| | | | |
|---|---|---|---|
| 663,718 | 12/1900 | Beatty | 126/343.5 R |
| 1,160,205 | 11/1915 | Smith . | |
| 1,388,027 | 8/1921 | Connolly . | |
| 1,602,476 | 10/1926 | Ballard . . | |
| 1,821,292 | 9/1931 | Chase . | |
| 1,841,245 | 1/1932 | Hagen . | |
| 2,602,443 | 7/1952 | Leary | 37/227 X |
| 2,605,760 | 8/1952 | Cayas | 37/228 X |
| 3,123,922 | 3/1964 | Spinelli | 37/228 |
| 3,155,089 | 11/1964 | Hoyt | 126/343.5 |
| 3,166,066 | 1/1965 | Dunn et al. | 126/343.5 |
| 3,171,405 | 3/1965 | Miller | 126/343.5 |
| 3,270,741 | 9/1966 | Petlak | 126/343.5 R |
| 3,304,632 | 2/1967 | Kotlar et al. | 37/12 |
| 3,309,798 | 3/1967 | Devlin et al. | 37/12 |
| 3,452,459 | 7/1969 | Campion | 37/12 |
| 3,464,128 | 9/1969 | Krickovich | 37/12 |
| 3,979,794 | 9/1976 | Brown | 37/12 |
| 4,409,957 | 10/1983 | Muhammad | 37/227 X |
| 4,506,656 | 3/1985 | Baasch | 126/343.5 |
| 4,785,561 | 11/1988 | Swanson | 37/197 |

FOREIGN PATENT DOCUMENTS

| | | | |
|---|---|---|---|
| 197606 | 8/1990 | Japan | 37/227 |

*Primary Examiner*—David H. Corbin
*Assistant Examiner*—Arlen L. Olsen
*Attorney, Agent, or Firm*—Anthony G. Eggink

[57] ABSTRACT

A snow melting apparatus (1) including a reduction chamber (4) into which heated air is forced by a burner (14). Heated air is distributed within the reduction chamber (4) by using a central conduit (13) to which are rigidly affixed heat exchanger pipes (15, 16, 17, 18) having open ends and being perforated by a plurality of downwardly facing slits (32, 33, 34). Heated water (26) is also distributed within the reduction chamber (4) by using a pump (28) and a perforated pipe (30).

19 Claims, 3 Drawing Sheets

SNOW MELTING APPARATUS

BACKGROUND OF THE INVENTION

1. Field of the Invention

This invention has relation to snow melting and removal apparatus wherein snow is removed from the ground, delivered into a snow melting chamber where it is conveyed to liquid water, and the liquid water is discharged through a discharge orifice and into an appropriate receptacle.

2. Description of Related Technology

The need to remove snow from streets has existed for centuries. In crowded inner city areas, snow cannot simply be plowed away, due to a lack of suitable storage surfaces. One logical way to remove snow from streets and highways in such conditions is by converting it into liquid water, and many devices have been developed to melt snow after it is removed from a street or alley.

One of the earliest such devices is described in U.S. Pat. No. 1,160,205, issued to Smith, which discloses a container into which snow is shoveled and then melted by applying heat to the bottom and sides of the container while spraying heated water directly onto the snow confined within the container. The Smith device includes means for tilting the container to drain the liquid water thus produced.

U.S. Pat. No. 1,821,292, issued to Chase, similarly uses a series of nozzles to spray heated water on snow that is deposited onto an inclined surface by a conveyor.

Also, U.S. Pat. No. 1,841,245, issued to Hagen, uses a conveyor to pass snow beneath a series of nozzles spraying hot water directly onto the snow to be melted.

U.S. Pat. No. 1,388,027, issued to Connolly, uses a series of burner nozzles to apply flame directly to the side of a chute through which snow passes so as to melt the snow, with water being directed onto snow exiting the chute so as to further aid the melting process.

U.S. Pat. No. 1,602,476, issued to Ballard, discloses a snow melting apparatus in which a combustion chamber is located adjacent to a snow containing chamber, with radiant heat thereby tending to melt the snow contained therein.

U.S. Pat. No. 3,123,922, issued to Spinelli, utilizes a conveyor carrying snow past nozzles discharging hot water into a tank, with the added feature that a series of blades agitates the snow so as to speed the melting process.

U.S. Pat. No. 3,155,089, issued to Hoyt, discloses a snow melting apparatus in which snow is directed across a pipe containing hot water and further directed by gravity into a tank containing hot water, thereby tending to melt the snow as it comes into contact with the heated water.

U.S. Pat. No. 3,166,066, issued to Dunn et al., discloses a snow melting apparatus using hot water dispensed from nozzles such that water is sprayed directly onto the snow. Some of the nozzle heads are mounted on a tiltable pipe grid so as to more accurately direct the hot water onto the snow.

U.S. Pat. No. 3,171,405, issued to Miller, discloses a tank into which bulk snow may be received and which contains a slurry of water and snow to which heat energy is supplied for melting additional snow added to the slurry. Miller utilizes fuel for inputting substantially all of the heat energy to the slurry which is necessary to melt the bulk snow to be added to the slurry.

U.S. Pat. No. 3,304,632, issued to Kotlar et al., discloses the use of high pressure, high velocity air supplied to an oil burner to provide a flow of combustion products and air into which snow is entrained, the snow presumably being carried to the end of the snow melting chamber 40 where the liquid water drops into an otherwise unheated water tank 60 while the combustion products in the remaining air pass out through exhaust stack 49.

U.S. Pat. No. 3,309,798, issued to Devlin et al., discloses the deposition of snow inside of a snow reduction chamber, onto an auger which moves the snow through a perforated tube as a slurry. While moving through the tube, water in a tank at the bottom of the snow reduction chamber is heated in a boiler and is introduced into the snow moving through the perforated cylinder, to be ultimately discharged at the open end thereof into the tank.

U.S. Pat. No. 3,452,459, issued to Campion, discloses the use of a high volume of air flow to first draw air from the ambient temperature atmosphere so as to entrain water vapor and moisture from melted and melting snow and secondly to carry the air and entrained water vapor back into the outside atmosphere. FIG. 1 of the Campion disclosure shows the discharge of snow from a snow blower into a snow reduction chamber equipped with a plurality of spaced apart cal rod units throughout the chamber. It also discloses in FIG. 5 the discharge of snow through the top of the snow reduction chamber into open ended and perforated tubes which are discharging the products of combustion into the chamber, with the discharge of water vapor coming out of the top of the snow reduction chamber. Campion appears to depend on the low humidity of cold ambient outside air to pick up the moisture laden air inside of the snow reduction chamber, and to depend on air flow (with its resultant dissipation of heat energy) to accomplish this transfer of air and moisture.

U.S. Pat. No. 3,464,128, issued to Krickovich, discloses a large pot into which snow is loaded, the pot being stirred by spokes of agitators 56 and 64, and the pot being heated using a series of gas burners 68. The snow first discharged into this pot, if the pot is preheated, will tend to flash over into vapor or immediately melt. When sufficient snow is built up so that the paddles of the agitator 56 are moving the snow, the snow and liquid water are present in the form of a slurry.

U.S. Pat. No. 3,979,794, issued to Brown, discloses the use of a mobile snow melting device in which snow is deposited into a container which is heated by a series of steam jackets. A series of small holes permits the steam within the jackets to enter the interior of the container directly.

U.S. Pat. No. 4,409,957, issued to Muhammad, discloses a series of parallel heating tubes within a container against which snow is placed and subsequently melts.

U.S. Pat. No. 4,506,656, issued to Baasch, discloses a trailer in which water of approximately 50° F. is placed into a turbulent chamber into which snow is deposited for melting. Heat is provided by the slightly warmed water and the agitation of the slurry tank.

U.S. Pat. No. 4,353,176, issued to Hess, discloses a combustion burner which produces combustion gases which are forced up flue pipes encircling the outside of a rounded V-shaped container and down into the snow which is collected in this container. An auger in the bottom of the container agitates the slurry of solid water, snow, ice and liquid water and tends to carry it toward the rear lower portion of the rounded V-shaped container. There the water flows up around the V-shaped container until it is drained away through an exit port.

U.S. Pat. No. 4,785,561, issued to Swanson, discloses a snow blower which deposits snow onto a series of horizontally aligned parallel heated tubes, contact with the tubes thereby causing the snow to melt.

All of the devices herein discussed have been optimized to conserve energy at the expense of inefficiently or slowly melting snow. A need still exists for a device which will rapidly melt large amounts of snow either in a vehicle or permanently mounted snow melting device which can be placed on a street, roof, alley or other area of large snow accumulation and melt the snow thus collected in a reasonably short period of time.

Summary of the Invention

The present invention addresses the problem of simplifying and speeding the melting of large accumulations of snow.

Before the present invention, a snow removal apparatus could include a motorized vehicle, a powered snow blower mounted on the front of the vehicle and having an outlet chute, a snow reduction chamber mounted on the vehicle, and a snow delivery conduit leading from the outlet chute of the snow blower to an upper portion of the snow reduction chamber.

The present invention includes a reduction chamber mounted, for example, in the rear portion of a standard flat bed vehicle, the snow being deposited by any convenient means into the reduction chamber from above.

Heated forced air is passed through a series of conduits or pipes which have been perforated so as to direct heated air downwardly onto a volume of water residing in the bottom of the reduction chamber. The snow deposited in the upper region of the reduction chamber acts as a lid or cover to the heated water chamber, thereby causing the temperature to rise and melt the snow residing in regions above the heated, liquid water.

A drain orifice is provided within the chamber to allow a portion of the water within the chamber to overflow, thereby leaving an air space between the surface of the water and the bottom surface of the snow which is being deposited into the reduction chamber.

DETAILED DESCRIPTION OF THE PREFERRED EMBODIMENTS

Figure 1:
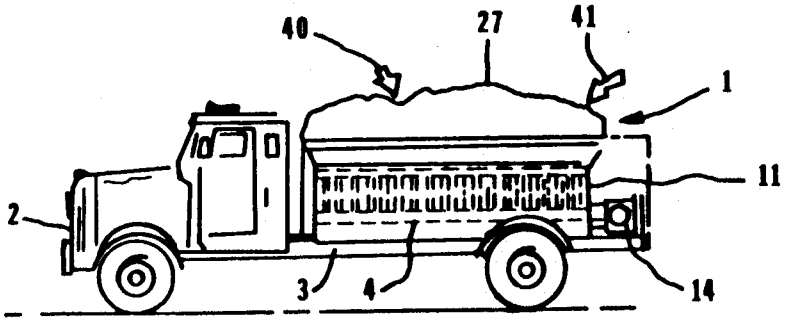
FIG. 1 is a side elevation of a motorized vehicle carrying a snow melting apparatus built in accordance with the principles of the present invention.

Referring generally to FIG. 1, the subject of the present invention is shown generally at 1, mounted on the back of a truck 2. The snow melter 1 can be advantageously mounted on the flatbed 3 of a truck 2, or could be mounted on its own separate trailer and attached by means of a hitch (not shown), or could be mounted on its own separate four-wheeled trailer to be moved and positioned by any suitable means. In the four-wheeled trailer version (not shown), ideally the front axle would be steerable to permit ease of positioning. Additionally, the snow melter 1 could be mounted permanently in an alley or on a rooftop, or other confined areas where snow accumulation is a recurring problem.

Figure 2:
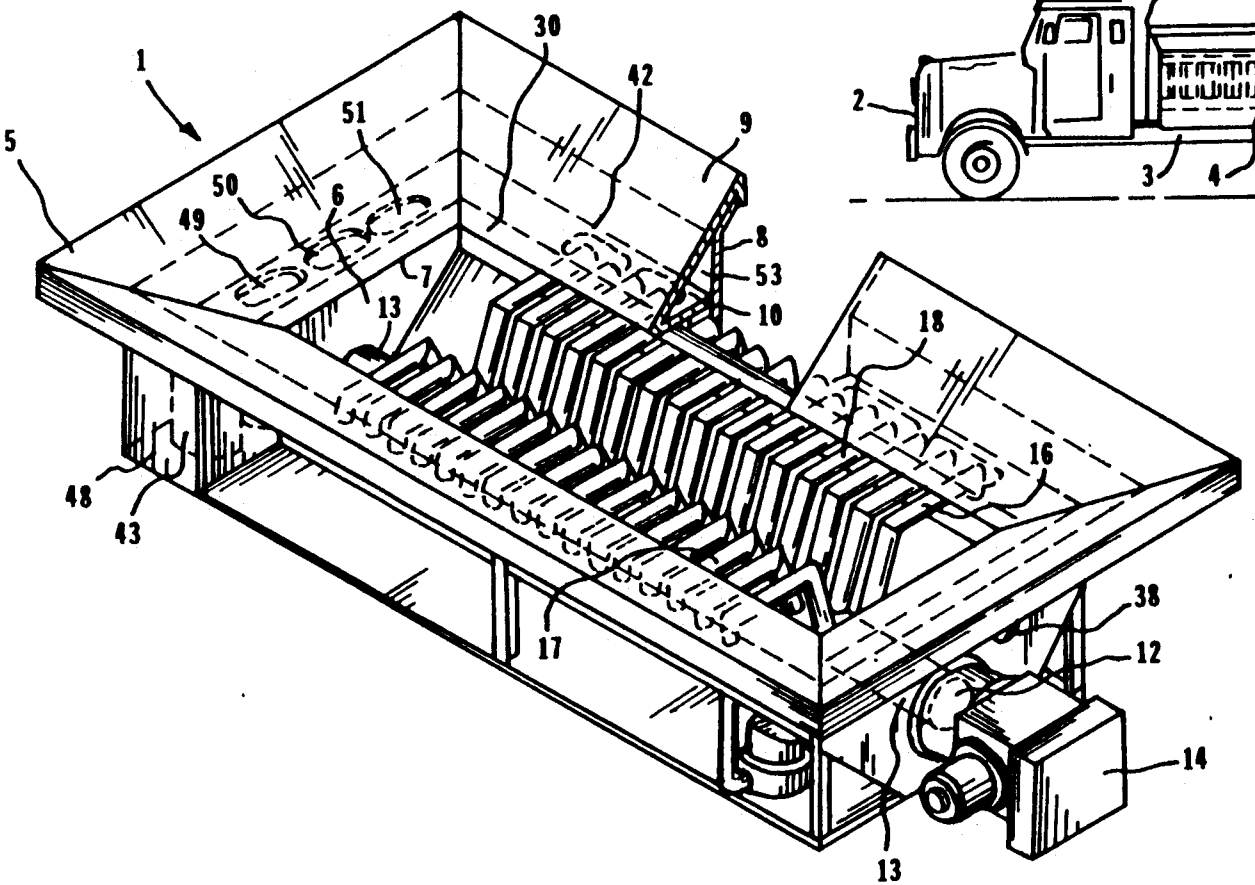
FIG. 2 is a perspective view showing the snow melting apparatus as depicted in FIG. 1.

As seen in FIG. 2, the snow melting apparatus 1 is formed as a substantially rectangular container 4 having, in a preferred embodiment, a length of approximately 17 feet and a width of approximately 7 feet. The height of container 4 is approximately 5 feet. The container 4 serves as a reduction, or melting, chamber in which snow is reduced, or converted, into liquid water.

The top or upper region of container 4 is an inlet chute and is formed so as to have a series of beveled or sloping edges 5 which join the vertical sides 6 of container 4 along but line 7.

The sloping sides 5 typically intersect vertical wall 6 along but line 7 at an angle of approximately 45°, but any convenient angle may be chosen in order to urge material into the interior of the container. The inlet chute defined by sloping sides 5 provides a sloped peripheral interior entry into container 4.

The container 4 and s side walls 5 may be constructed of any suitable material, but in view of the extreme temperatures encountered by the device during operation, a heavy material such as steel would typically be used. Due to the weight of the collected snow resting against sloping sheets 5, the container 4 is constructed so as to have vertical side walls 8 supporting outer region 9 of sloping wall 5. Additional support is provided by horizontal brace 10 which abuts vertical wall 8 along butt line 11, and is rigidly secured thereto by some suitable means such as welding.

Figure 3:
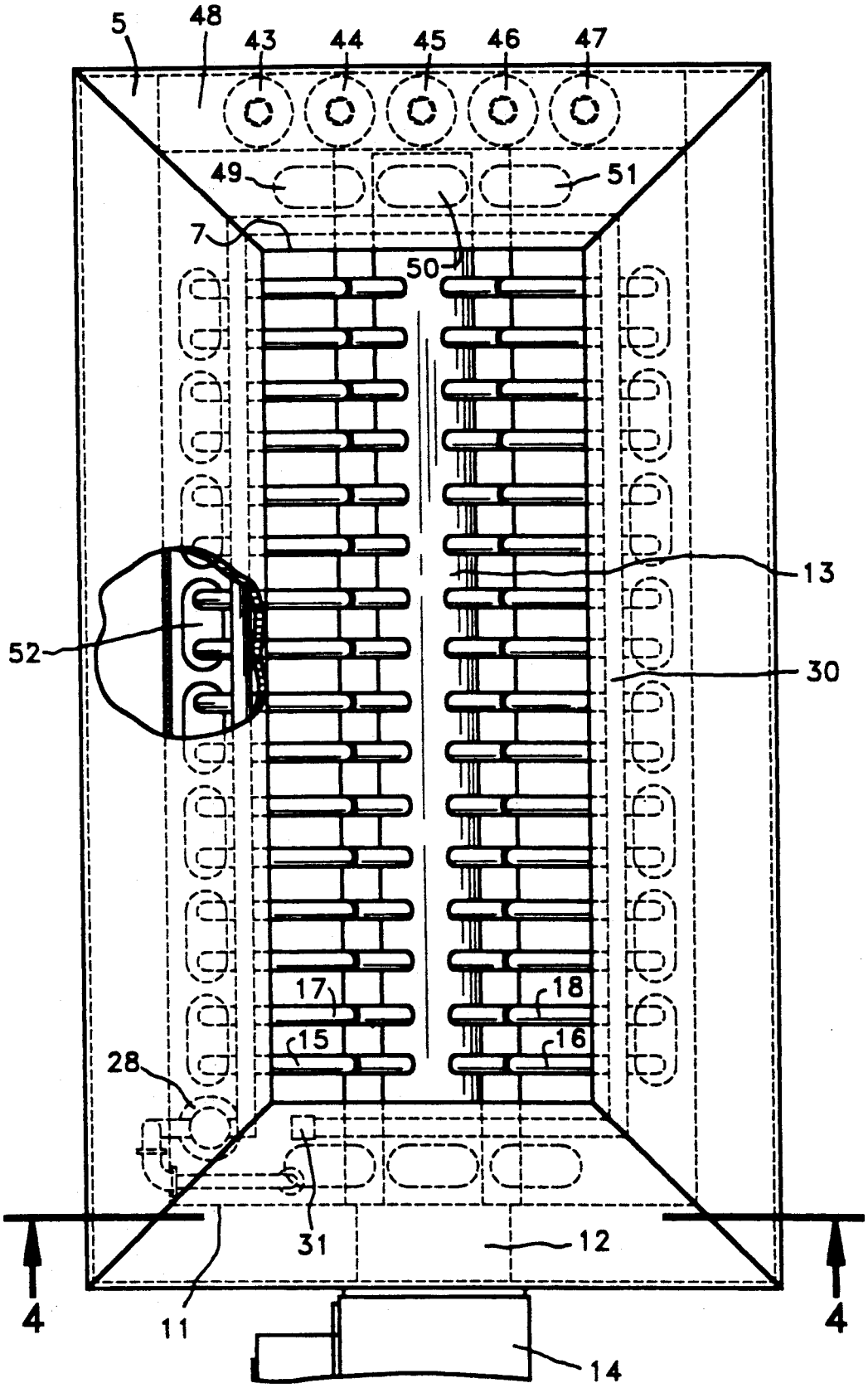
FIG. 3 is a top plan view of the snow melting apparatus as depicted in FIG. 1.
Figure 4:
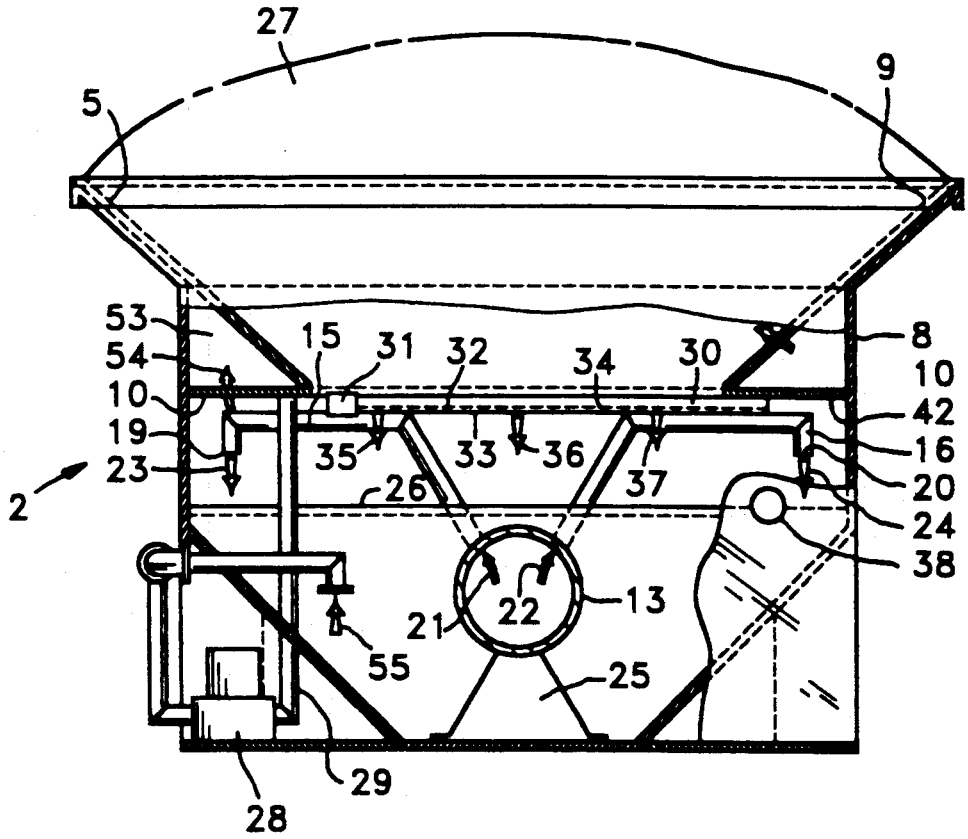
FIG. 4 is a rear elevation of the snow melting apparatus as depicted in FIG. 1, taken generally along section line 4—4 as shown in FIG. 3.

Referring to FIG. 3, at one end 11 of container 4 is a circular opening 12 which permits access to central channel 13. Central channel 13 can be formed as a tubular pipe, approximately 16 inches in diameter, of a suitable material such as steel. Adjacent to end 11 of container 4, the opening 12 leading to channel 13 is in fluid communication with burner 14, which may be a heater of any suitable type, such as oil burning, propane fueled, or any of a variety of multi-fuel burner. The products of combustion, flue gases or effluent are expelled from burner 14 into channel 13. In a preferred embodiment, the air temperature the burner is approximately 1500° F. The burner 14 typically contains a fan (not shown) to force air from the burner through a suitable exit orifice. Fuel containers 43, 44, 45, 46 and 47 for the burner 14 may be advantageously stored on surface 48 of container 4 or conveniently mounted elsewhere on truck 2. Entering channel 13 along its upper half are a series of heat exchanger pipes or conduits 15, 16, 17, 18, etc. Each of these pipes is in fluid communication with central channel 13, and are, in a preferred embodiment, approximately 2 inches in diameter and spaced longitudinally along central channel 13 at a spacing of approximately 6 inches. As seen in FIG. 4, the ends of the pipes 19, 20, etc. are open, permitting fluid passing through burner 14 and along channel 13 to be forced upwardly through heat exchanger pipes 15 and 16, for example, and out of ends 19 and 20. The ends of the pipes 15, 16, 17, 18, etc., are pointed downwardly into the interior of container 4 above the water fill line. As seen in FIG. 4, fluid passing along channel 13 follows the path of arrows 21 and 22 into pipes 15 and 16 respectively and exits along paths 23 and 24. Channel 13 may be conveniently supported by base 25 at various points along its length within container 4. Also, surface 10 is perforated periodically by elongated orifices 49, 50, 51, 52, etc. These perforations permit heated air exiting from pipes 15, 16, 17, 18, etc. to enter the region 53 above surface 10, along the path shown generally 54. In this manner, the snow 27 abutting side walls 5 of the inlet chute may be heated, further enhancing the snow melting process.

An additional feature of the present invention includes a warm water recirculation and spray system which operates using water 26 residing in container 4 and produced by the result of melting snow 27. Water 26 enters pump 28 along path 55. Water 26 travels upwardly from pump 28 through pipe 29 and horizontally along pipe 30. The end 31 of pipe 30 is capped, but pipe 30 along its underside is pierced by a series of perforations 32, 33, 34 etc. which permit water to be forced downwardly into the interior of container 4. The orifices 32, 33, 34, etc. are most advantageously formed as elongated slits and water escaping through these orifices typically follow paths as indicated by arrows 35, 36, and 37. The combined effect of the heated water and air forms an upper level curtain or layer of heated fluids near the top of the container which tends to melt snow almost instantaneously as it is deposited into the container.

As melted snow accumulates in the form of water in the interior of the container 4, the water may be removed through orifice 38 and drained away by means of hose (not shown) or other suitable conduit. The orifice 38 is located so as to permit a volume of approximately $\frac{2}{3}$ of the interior capacity of container 4 to be filled with water. The orifice 38 defines the water fill line in container 4.

In operation, the container or tan 4 is filled initially with water to the level of orifice 38, and the burner 14 and pump 28 is energized. The burner 14 is controlled by a thermostat (not shown), which permits the water temperature to be maintained at a temperature of approximately 100° F. As snow 27 is deposited downwardly, as indicated by the directions of arrows 40 and 41, into container 4, the snow 27 comes into contact with the plurality of heat exchanger pipes 15, 16, 17, 18, etc. as well as the heated water 26 and the heated water exiting pipe 30 through the various orifices 35, 36, 37, etc. The combination of the heated water and the warmth radiated directly from the heat exchanger pipe rapidly reduces the snow 27 into water which melts into tank 4 and, as the level of water 26 rises, the water is drained out through orifice 38.

Although the present invention has been described with reference to preferred embodiments, workers skilled in the art will recognize that changes may be made in form and detail without departing from the spirit and scope of the invention.

I claim:

1. A unitary snow melting apparatus, comprising:

a. heat producing means including a fuel burner producing effluent gases;

b. a reduction chamber having a bottom, a top inwardly sloping peripheral inlet chute and an interior region with a predetermined fill line;

c. a fan being adapted to provide combustion air to the burner and to force the effluent gases from the heat producing means into the reduction chamber above the fill line;

d. heat distribution means for distributing the heated effluent gases throughout the interior region of the reduction chamber so as to elevate the temperature of material residing on the heat distribution means and within the interior of the reduction chamber; and wherein the heat distribution means includes an outlet positioned above said water line and extending underneath a lower portion of the inlet chute, whereby said effluent gases are received by said lower portion of said inlet chute; and e. water distribution means having water outlet means positioned adjacent said inlet chute periphery and for circulating water thereto from below said chamber fill line.

2. The snow melting apparatus of claim 1, wherein the heat distribution means further comprises:

(a) a central channel, the central channel being in fluid communication with the heat producing means, thereby confining effluent produced by the heat producing means to initially travel within the channel; and (b) a plurality of heat exchanging conduits, the heat exchanging conduits being in fluid communication with the channel such that heated effluent traveling within the channel is diverted so as to travel along paths defined by interior regions of the heat exchanger conduits.

3. The apparatus of claim 2 wherein the channel is formed as a substantially circular conduit, the conduit spanning substantially all of a lengthwise dimension of the reduction chamber.

4. The apparatus of claim 3, wherein each heat exchanger conduit is rigidly affixed to and perforates the circular conduit so as to permit fluid communication between interior regions of the circular conduit and each heat exchanger conduit.

5. The apparatus of claim 4, wherein the heat exchanger conduits are arranged in a series of symmetrically spaced pairs, each pair being separated from a subsequent pair by a distance of approximately 6 inches.

6. The apparatus of claim 5, wherein the diameter of each heat exchanger conduit is approximately 2 inches.

7. The apparatus of claim 6, wherein the diameter of the central conduit is approximately 16 inches.

8. The apparatus of claim 7, wherein each heat exchanger conduit is rigidly affixed to the central conduit in a region defined by an upper half of the central conduit.

9. The apparatus of claim 8, wherein each heat exchanger conduit is perforated by a series of elongated slits, the slits permitting heated effluent within the heat exchanger conduits to exit from the heat exchanger pipe.

10. The apparatus of claim 9, wherein each of the elongated slits perforating each heat exchanger conduit is located in a lower region of the heat exchanger conduit.

11. The snow melting apparatus of claim 1, wherein said water distribution means includes a pump.

12. A method of melting snow, comprising the steps of:

a. depositing snow into a sloped top inlet chute of a reduction chamber having a predetermined water fill line;

b. melting the snow by heating an interior region of the reduction chamber and undersides of the sloped inlet chute with effluent gases expelled from heat exchanging conduits having an outlet above the fill line and extending below the sloped inlet chute, said conduits being in communication with a fuel burner, such that the snow melts;

c. collecting at least a portion of the melted snow in a lower region below the fill line of the reduction chamber;

d. pumping the melted snow from the interior region below the fill line of the reduction chamber; and e. spraying the pumped water from the periphery of the inlet chute into an interior region of the reduction chamber so as to promote further melting of snow within the interior of the reduction chamber.

13. A snow melting apparatus, comprising:

a. a reduction chamber having a bottom, opposing sides, an open top and an interior space having a predetermined fill line, said open top having sloping plates defining a peripherally sloped inlet chute;

b. a fuel burner communicating with a fluid distribution system positioned at the bottom of said reduction chamber, said fluid distribution system having a plurality of heat exchanging conduits angularly disposed in said chamber interior space below said inlet chute and below said fill line and terminating above said fill line and below said sloping plates such that effluent gases are received by at least a portion of a lower side of said sloping plates; and c. a water distribution system having pump means and conduits to distribute water from below said chamber fill line to the periphery of said inlet chute.

14. The snow melting apparatus of claim 13, wherein said heat exchanging conduits extend upwardly in a plurality of opposing pairs and in an aligned V-shaped configuration.

15. The snow melting apparatus of claim 13, wherein said fluid distribution system is further comprised of a central conduit spacially fixed from said chamber bottom and wherein said heat exchanging conduits extend upwardly therefrom at an upper half region thereof and have open ends disposed above said fill line.

16. The snow melting apparatus of claim 15, wherein said fill line in said reduction chamber is maintained by a water outlet means disposed above said central conduit and below said heat exchanger conduit ends.

17. The snow melting apparatus of claim 13, wherein said water distribution system further has a plurality of spray nozzles positioned about the periphery of said inlet chute.

18. The snow melting apparatus of claim 13, wherein said sloped inlet chute is comprised of abutting steel plates having a predetermined angle and defining an inner upper sloping peripheral portion within said chamber.

19. The snow melting apparatus of claim 13, wherein said reduction chamber includes sloping bottom plates to define a lower sloping interior chamber portion for receiving water and melted snow.

* * * * *